United States Patent [19]

Zimmermann

[11] 4,194,439

[45] Mar. 25, 1980

[54] METHOD OF MAKING COLLAPSIBLE PAPERBOARD CUP

[75] Inventor: John Zimmermann, Willowdale, Canada

[73] Assignee: Somerville Belkin Industries Limited, London, Canada

[21] Appl. No.: 866,561

[22] Filed: Jan. 3, 1978

[51] Int. Cl.[2] ..... B31B 7/00

[52] U.S. Cl. ..... 93/36.05; 93/36.6; 93/36.01

[58] Field of Search ..... 206/416, 418, 192, 193; 93/36.6, 36.01, 36 M, 36 R, 58 R, 49 R, 36.05; 53/175; 220/404, 416

[56] References Cited

U.S. PATENT DOCUMENTS

| | | | |
|---|---|---|---|
| 2,098,090 | 11/1937 | Ford | 206/602 X |
| 2,205,437 | 6/1940 | Ringler | 93/36.6 X |
| 2,799,211 | 7/1957 | Zerlin et al. | 93/36.01 |
| 3,227,054 | 1/1966 | Helms et al. | 93/36.01 |
| 3,878,771 | 4/1975 | Malcolm | 93/36.6 X |

*Primary Examiner*—James F. Coan

*Attorney, Agent, or Firm*—Fetherstonhaugh & Co.

[57] ABSTRACT

A method of making a folded lined paperboard container having an automatic bottom which locks in a set-up position when the container is manually manipulated from a flat knock-down condition to a set-up position and having a liquid proof liner made of a plastics material is disclosed. Two lined containers are made from each lined blank by cutting the folded blank transversely of side panels between the edges of a band of adhesive extending transversely of the side panels.

3 Claims, 7 Drawing Figures

METHOD OF MAKING COLLAPSIBLE PAPERBOARD CUP

This invention relates to a method of making folded containers and also to a folded container.

The type of container with which the invention is concerned is a folded paperboard container preferably with an automatic bottom that can be manually manipulated from a flat knock-down condition to a set-up position and that has a liquid proof liner made of a plastics material. These containers are used quite extensively in hospitals where there is a requirement for a handy container that is relatively inexpensive. They are, for example, used to contain sterilizing solutions for surgical instruments where it is desirable to throw the container away after one instrument has been sterilized. A catheter is an example of such a hospital instrument.

Containers of the general type under consideration are not new as of the date of this invention. It was previously known to have an open topped paperboard container with hinged side walls and flaps on the side walls interconnected for articulation as the side walls are operated from the flat position to an operative position to form a bottom wall wherein a plastic liner was secured to the marginal portions of the opening. In use, the plastic liner retained the sterilization or other hospital solution and, on completion of a single use, practice was to dispose of the container after emptying the contents. The securement of the liner to the container, however, has given rise to manufacturing difficulties that have added to the cost of these containers. As indicated, these containers are customarily used once only and cost is an important factor.

This invention involves a new structure and a method of making it that reduces the cost of manufacture and, in addition, provides a product that is better suited for hospital use because it is easier to ensure that the product is sterile.

The method of making folded containers according to this invention comprises the steps of taking a flat blank for a tubular container that has side panels and bottom flaps for a lock bottom at each end; taking a length of plastics sheet material in lay flat tubular form with a transversely extending seal line adjacent each of its ends; said length of plastics material having a lay flat width equal to one-half the combined width of said panels of said blank; applying a band of adhesive transversely across the side panels of said blank; laying said sheet material on said blank with its width extending across adjacent side panels; and folding the side panels and bottom flaps of said flap blank to make a folded lock bottom container with said liner adhered to the inside of the side panels thereof over said band of adhesive that extends across said side panels. The method of making the container and the novel structure resulting therefrom will be apparent to those skilled in the art after reading the following detailed specification read in conjunction with the drawings.

The drawings illustrate a flat blank for a tubular container that has side panels and bottom flaps for a lock bottom at each end. Tubular containers with lock bottoms that automatically open into place as the container is moved from a folded to a set up position are not broadly new and there is nothing basically new in the tubular container form illustrated with the exception that it has a lock bottom at each end that makes it specially useful in this invention.

The blank illustrated comprises side panels 10, 12, 14 and 16 and bottom flaps 18, 20, 22 and 24. There is a similar series of bottom flaps at each end of the container and these flaps have been similarly numbered at each end. Flaps 18 and 22 have bottom articulating tabs 26 and 28 connected thereto by a perforated line and, in use, function to cause the bottom to automatically set-up as the container is moved from a folded to a set-up position as will be apparent later. The bottom construction is not new of itself.

As indicated in the preamble, the invention is concerned with a paperboard container having a liner of a waterproof plastics material and the plastics material is adhesively secured to the container blank when the container blank is in the open unfolded position. The plastics material is in the form of a tubular sleeve with transversely extending seal lines 32 at each of its ends. The length of the piece of tubular material is such that it extends at each end over the ends of the side panels and its width corresponds to the width of two adjacent side panels of the blank.

Figure 1:
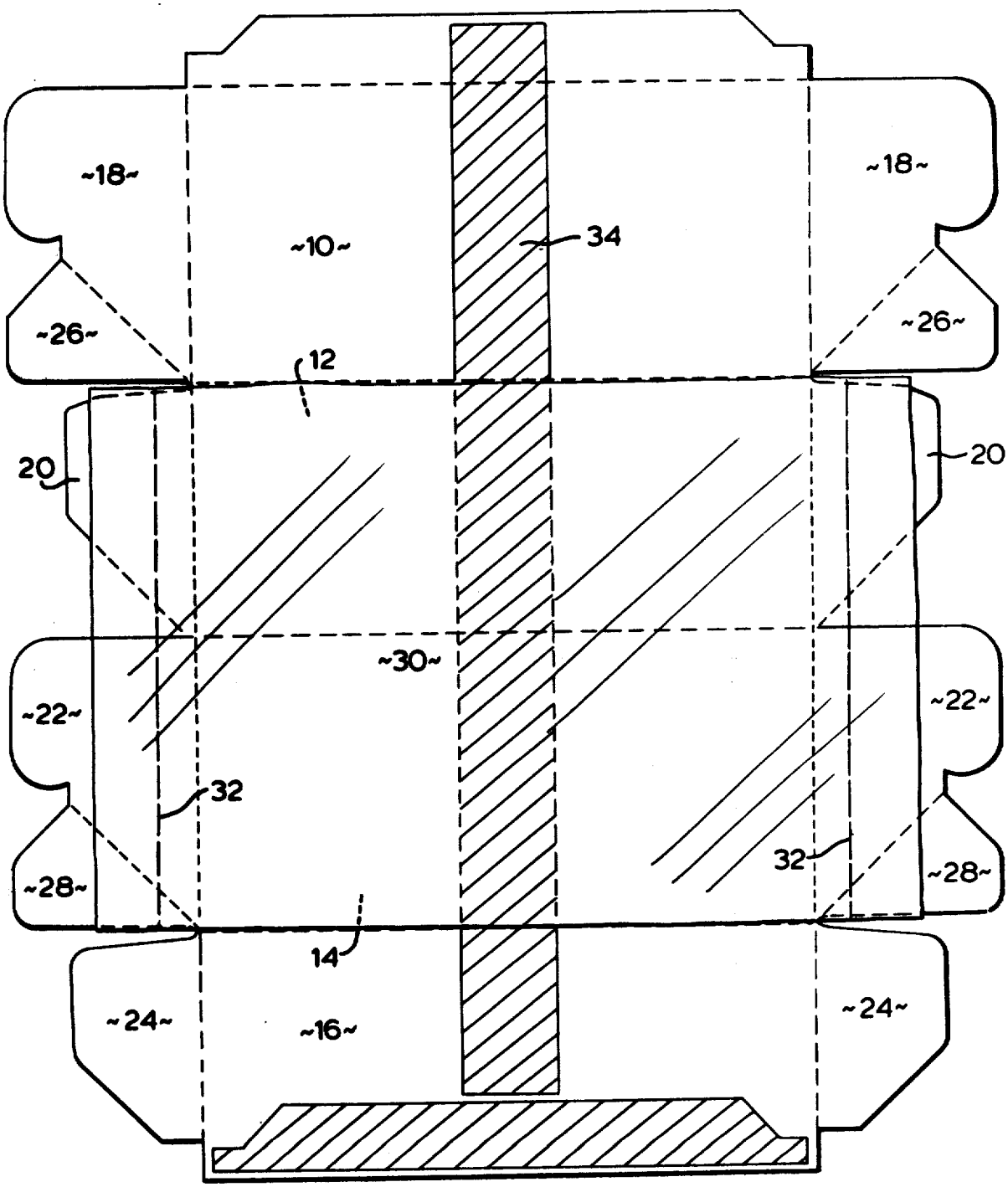
FIG. 1 is a view of the paperboard blank from which the automatic bottom outer container is made showing the glue areas with a plastic liner overlaid.
Figure 2:
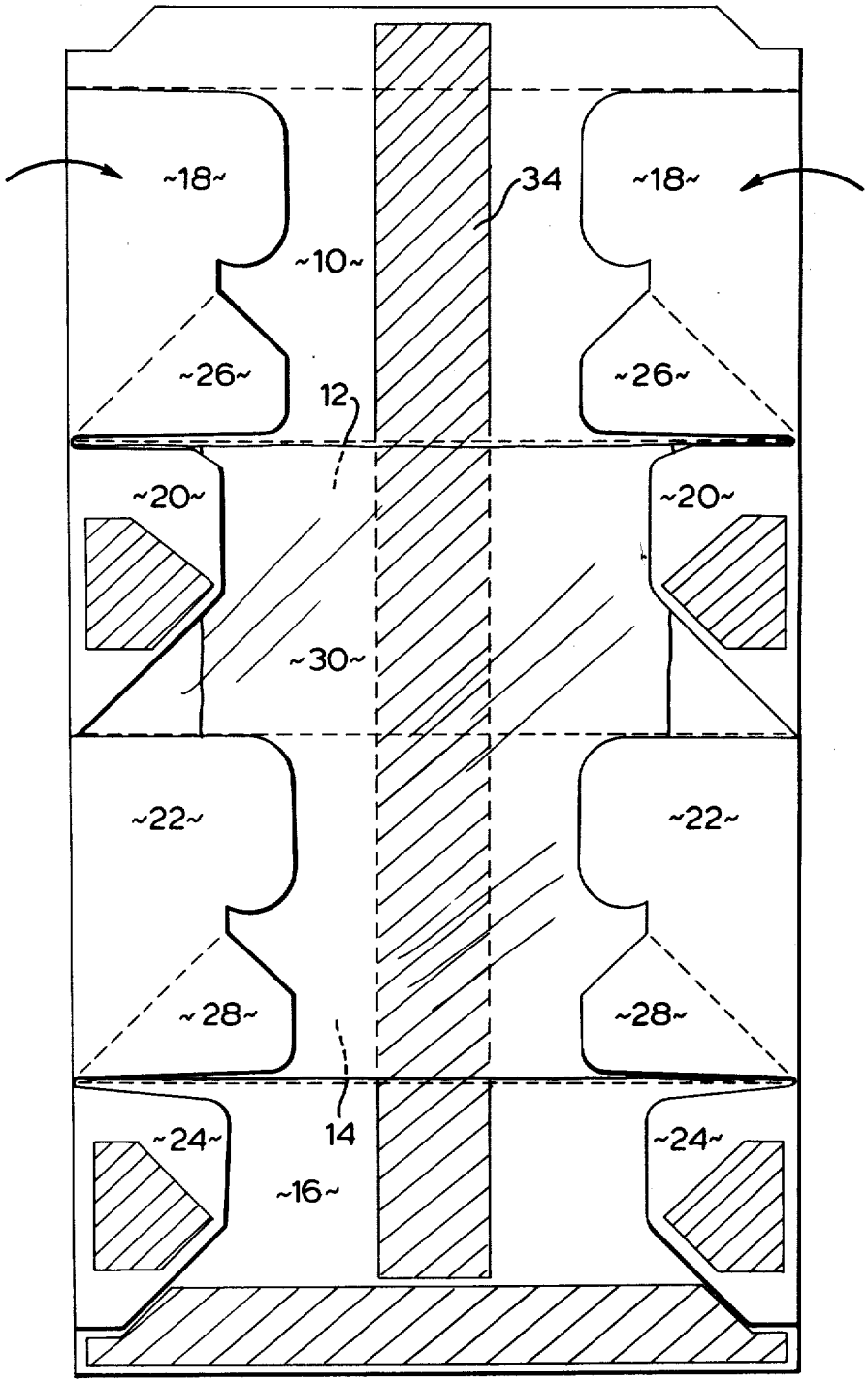
FIG. 2 is a view of the paperboard blank with the bottom flaps partially folded.
Figure 3:
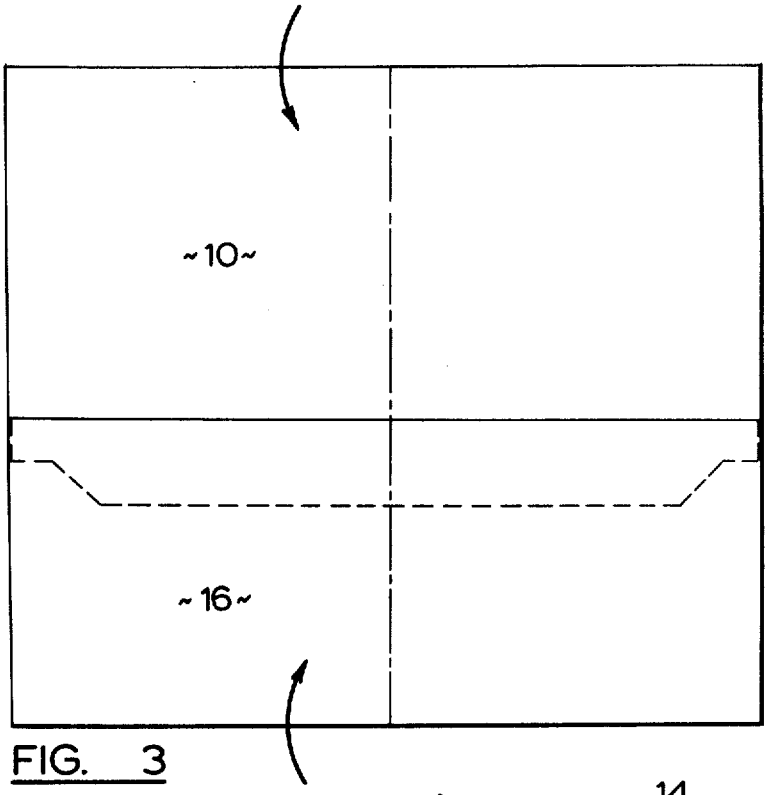
FIG. 3 is a view showing the final folding process.
Figure 4:
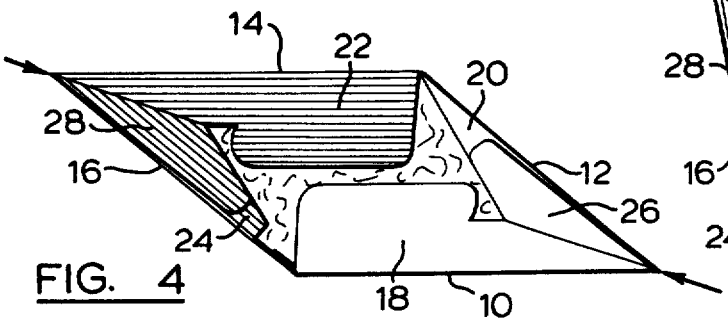
FIG. 4 is an end view on line 4—4 of FIG. 3 showing one of the cups starting to be assembled by pressure applied to the diagonally opposite corners as indicated by the arrows.
Figure 5:
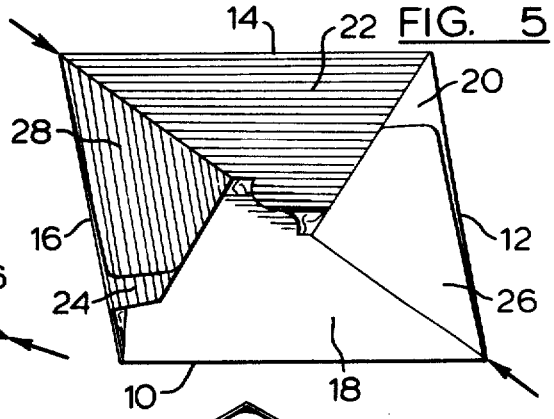
FIG. 5 is a view similar to FIG. 4 but shows a stage further in the assembly by continued pressure along the arrows.
Figure 6:
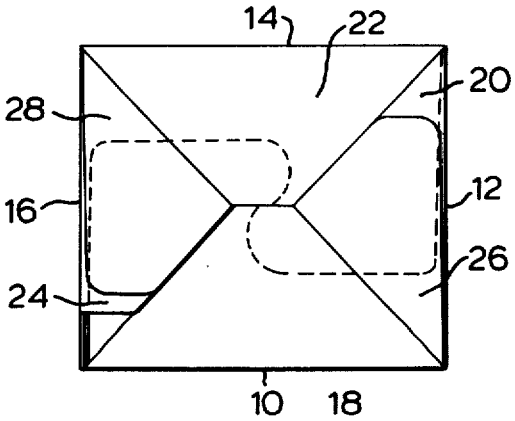
FIG. 6 is a view similar to FIG. 5 but shows the assembly now completed.
Figure 7:
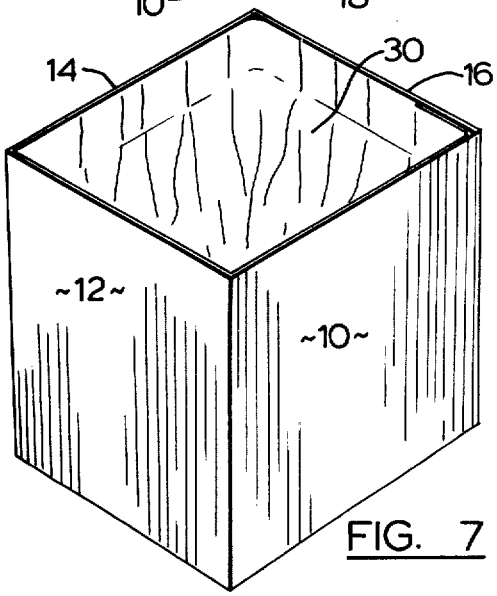
FIG. 7 is a perspective view of the open top of the assembled container.

Prior to folding the blank and prior to laying the sleeve of plastics material in place, adhesive is applied to the blank. It is applied to the bottom flap at the hatched areas and in accordance with known practice. It is also applied in a band transversely across the side panels 10, 12, 14 and 16 at the hatched areas. After the adhesive is applied, the tubular lay flat plastic liner is laid over panels 12 and 14. The underside of the liner is, thus, adhered to the plastics sleeve. Following that, the side panels and bottom flaps of the blank are folded as illustrated in FIGS. 2 and 3. After the bottom flaps have been folded into position, the container is folded into tubular form as indicated in FIG. 3. The structure, thus formed consists of twin containers in lay flat folded form which can be separated after the adhesive has dried by cutting the side walls in a transverse direction to substantially bisect the glue strip 34.

After cutting, it will be apparent that one has from each folded unit two cups which can be set-up by pressing opposed edges of the folded construction to form the side walls into a square configuration and automatically open and form a bottom for the container as a result of the interconnection of the glued bottom flaps.

It will be apparent that the plastic liner in each of the twin cups is adhesively secured to the open edge of its respective cup at the inside marginal edge of the cup. The inside of the plastic tube is as sterile as the plastic tube was at the time of manufacture because steps. Moreover, it is quite possible to ship the cups as illustrated in FIG. 3, in twin form, for separation into the individual cups at the time of use at the hospital. This method of shipping, again, is such that the opportunities for contamination of the cup between manufacture and use are minimal.

The products can be made on automatic machinery in accordance with known methods. The lay flat tubular plastics inserts 30, for example, are formed in a continuous line on a bag making machine and can be laid on the blanks as described above on a window patch machine which can be adapted to automatically fold the bottoms and sides and form the folded flat container, as illustrated in FIG. 3. This is standard machinery and would be operated in substantially standard ways and does not form part of the present invention. Of importance, in the method is the laying in of the plastics liners and the securement of the plastics liners along the glue strip 34 so that, when the twin cup formation is completed, it can be simply cut transversely of itself along the midline of the glue strip 34 to provide two sanitary disposable cups with a liner neatly and securely in place.

Embodiments of the invention other than the one illustrated will be apparent to those skilled in the art and it is not intended that the invention be restricted to the method and structure described.

What I claim as my invention is:

1. A method of making a folded cup assembly comprising the steps of:

taking a flat blank for a tubular assembly that has side panels and bottom flaps for a lock bottom at each end;

taking a length of plastics sheet material in lay flat tubular form with a transversely extending seal line adjacent each of its ends;

said length of plastics material having a lay flat width equal to one-half the combined width of said panels of said blank;

applying adhesive to the blank including a band of adhesive transversely across all of the side panels of said blank intermediate the ends of the side panels;

laying said length of plastics sheet material on said blank with its width extending across adjacent side panels; and folding the side panels and bottom flaps of said flat blank to make a tubular folded cup assembly with said liner adhered to the inside of the side panels thereof over said band of adhesive that extends across said side panels, said folded cup assembly being separable to form two individual cups by cutting said folded blank transversely of said side panels between the edges of said band of adhesive that extends transversely of said side panels.

2. A method of making a folded cup assembly as claimed in claim 1 having four side panels.

3. A method of making a folded cup assembly comprising taking a flat blank for a tubular container that has a series of hinged side panels; taking a length of tubular plastics material with a transversely extending seal line adjacent each of its ends having a lay flat width equal to one-half the combined width of the side panels of said series of side panels;

applying adhesive to said blank including a band of adhesive that extends transversely across all of said side panels intermediate the ends of the side panels;

laying said length of tubular plastics material on said blank with its width extending across adjacent side panels; and folding the side panels to make a folded cup assembly of tubular form with said tubular plastics material adhered to the inside of the side panels over said band of adhesive that extends across said side panels whereby to form a folded cup assembly separable to form two individual cups by cutting said folded blank transversely of said side panels between the edges of said strip of adhesive that extends transversely of said side panels.

* * * * *